US007257977B2

(12) United States Patent
Arvedi

(10) Patent No.: US 7,257,977 B2
(45) Date of Patent: Aug. 21, 2007

(54) THERMO-ELECTROMECHANICAL PROCESS AND SYSTEM FOR COILING AND UNCOILING AN IN-LINE HOT ROLLED PRE-STRIP FROM THIN SLAB CONTINUOUS CASTING

(76) Inventor: Giovanni Arvedi, Via Mercatello 26, 26100 Cremona CR (IT)

( * ) Notice: Subject to any disclaimer, the term of this patent is extended or adjusted under 35 U.S.C. 154(b) by 0 days.

(21) Appl. No.: 10/554,632

(22) PCT Filed: Jul. 8, 2004

(86) PCT No.: PCT/IT2004/000378

§ 371 (c)(1),
(2), (4) Date: Oct. 25, 2005

(87) PCT Pub. No.: WO2005/009640

PCT Pub. Date: Feb. 3, 2005

(65) Prior Publication Data

US 2006/0201222 A1 Sep. 14, 2006

(30) Foreign Application Priority Data

Jul. 28, 2003 (IT) ..... MI2003A1546

(51) Int. Cl.
*B21B 27/06* (2006.01)

(52) U.S. Cl. ..... 72/202; 72/148; 72/200; 72/128; 72/364; 72/227; 29/527.7

(58) Field of Classification Search ..... 72/148, 72/202, 128, 200, 364, 227; 29/527.7
See application file for complete search history.

(56) References Cited

U.S. PATENT DOCUMENTS 3,859,829 A * 1/1975 Krall et al. ..... 72/12.1
4,430,874 A * 2/1984 Tippins et al. ..... 72/202
4,630,352 A 12/1986 Ginzburg et al.
4,630,785 A 12/1986 Buchegger et al.
4,703,640 A * 11/1987 Buchegger et al. ..... 72/128

(Continued)

FOREIGN PATENT DOCUMENTS

DE 30 00 638 A1 7/1980

(Continued)

OTHER PUBLICATIONS

ISP- Thin Slab Challenge to Nucor, Steel Times, Fuel & Metallurgical Journals Ltd. London, GB, vol. 221, No. 10, pp. 416, 418-419, XP000407075.

(Continued)

*Primary Examiner*—Dmitry Suhol
(74) *Attorney, Agent, or Firm*—Lucas & Mercanti, LLP

(57) ABSTRACT

A system and the relevant thermo-electromechanical process with two superimposed devices (A) able to coil and uncoil a pre-strip (*a*) by reversing their positions, provided with outer (4) and inner (7) burners to respectively equalize and optimize the temperature along the whole pre-strip by means of special algorithms of the control software, suited to also control the speed, acceleration and deceleration, both in the coiling and uncoiling step, of the chuck (6) up to the advanced stop during coiling to let a segment of tail (*c*) of the pre-strip out of the device (A). A particular structure of the chuck (6)is also described.

7 Claims, 2 Drawing Sheets

U.S. PATENT DOCUMENTS

| | | | | |
|---|---|---|---|---|
| 5,009,092 | A * | 4/1991 | Buchegger | 72/148 |
| 5,131,134 | A * | 7/1992 | Quambusch et al. | 29/527.7 |
| 5,195,344 | A | 3/1993 | Masuda et al. | |
| 5,430,930 | A * | 7/1995 | Passoni et al. | 29/527.6 |
| 5,690,485 | A | 11/1997 | Mangham et al. | |
| 5,778,716 | A * | 7/1998 | Moser | 72/202 |

FOREIGN PATENT DOCUMENTS

| | | |
|---|---|---|
| DE | 85 36 151 U | 2/1986 |
| DE | 4013582 C1 | 7/1991 |
| WO | WO96/32509 | 10/1996 |

OTHER PUBLICATIONS

Derwent Publications Ltd., London, GB, AN 2001-576052, KR 2001 019 326 A, (Po Hang Iron & Steel) Mar. 15, 2001.

Derwent Publications Ltd., London, GB; AN 1986-211068, SU 1 202 653 A, (InST Chernoi Metallurgii) Jan. 7, 1986.

* cited by examiner

THERMO-ELECTROMECHANICAL PROCESS AND SYSTEM FOR COILING AND UNCOILING AN IN-LINE HOT ROLLED PRE-STRIP FROM THIN SLAB CONTINUOUS CASTING

This patent application claims the benefit of priority from Italian Patent Application No. MI2003 A 001546 filed Jul. 28, 2003 through PCT Application Serial No. PCT/IT2004/000378 filed Jul. 8, 2004, the contents of each of which are incorporated herein by reference.

The present invention relates to a process and related system formed by a double superimposed electromechanical device, heated by gas burners and adapted to coil and uncoil at a controlled speed pre-strips of steel fed from a thin slab casting apparatus with in-line hot rolling ("cast rolling"), able to connect in a controlled way such a step with the following one of final rolling, being separated therefrom by different working speeds.

It is known in manufacturing plants for flat steel products, to use apparatuses for temporarily coiling the products ahead of the hot finishing rolling mill in order to separate the low velocity portion connected to the continuous casting from the finishing rolling mill that functions on the contrary at higher speed, so as to form coils usable as a store stock. A typical apparatus is the so-called "coil box" developed by Selco and employed both in conventional plants and for the so-called "mini-mills" using the thin slab technology.

This system is substantially formed by a series of input rolls for bending and causing the flat product to be coiled, as well as by powered rolls suitable to impart to the product the required rotation for the formation of the coil, freely occurring without any central chuck and without any protection shell. The used apparatus has however some disadvantages, the first of which is the impossibility of coiling thin slabs or pre-strips having a thickness lower than 15 mm, the danger being the collapsing of the coil on itself which would prevent the subsequent uncoiling thereof. Furthermore the absence of an outer shell involves temperature loss problems due to irradiation and non homogenous temperature, which make difficult the achievement of good quality products, from the point of view of both their geometry and mechanical properties.

It is true that patent U.S. Pat. No. 4,703,640 attempts to solve these problems by providing an embedding and the possibility of using a conventional chuck, while DE 4013582 provides a possible solution with two coilers, each of them embedded in its own shell and mutually superimposed, but both solutions have technical disadvantages. Disadvantages which are due to the presence of heads and tails, unavoidably colder than the central portion of the strip; that entail problems in the subsequent rolling process particularly in the case of thin and ultra-thin gauges, thus giving rise in particular to:

- the impossibility of controlling the pre-strip temperature as the apparatus have no heating systems, and accordingly the impossibility to produce strips with limited tolerances or particular characteristics such as thermo-mechanical steels of the dual phase or HSLA type;
- the lack of control of the coiling/uncoiling speed of the pre-strip, and therefore the impossibility to produce thin and ultra-thin strips with strict tolerances owing to the stretches ensuing from a non-controlled unwinding;
- problems for the so-called "refusals" of the rolling stands to accept a material showing at the head zone, in a length of few centimetres, temperature differences of some tens of degrees;

- out-of-tolerance in the first and last strip lengths (tens of meters), particularly in the production of thin and ultra-thin strips;
- incorrect positioning or "out-of-table" of the head with a consequent warping of the first strip meters, with consequent problems of strip stability and coiling;
- incorrect positioning or "out-of-table" of the tail with consequent damages of the strip and rolling rolls.

WO 96/32509 provides for two superimposed steel strip coiling and uncoiling devices having induction heaters only on the strip exit guides to the outside, made as roller paths, without any possibility of optimising and making uniform the temperature along the whole strip.

Still with reference to the aforesaid patents, it is possible to note that to avoid any cooling of the strip tail, the latter would have to be coiled internally, but this implies remarkable difficulties to withdraw the same, otherwise the device should have a wide opening, condition that would cause remarkable temperature losses; for these reasons such apparatus have no practical applications.

Starting from the described problems and disadvantages of the prior art, the present invention aims at improving a device for coiling/uncoiling a pre-strip from an in-line casting and rolling system, while ensuring to said product a high level of heat uniformity and an electronic control of the coiling/uncoiling speed, regarded as essential in order to obtain a final product with strict geometric tolerances and uniform mechanical properties.

This object is achieved according to the invention by means of an electromechanical system having the features as stated in claim 1, and a process according to claim 4.

Further objects, advantages and features of the system according to the present invention, as well as the relevant process, will be clear from the following description of a preferred embodiment thereof with reference to the attached drawings wherein.

Figure 1:
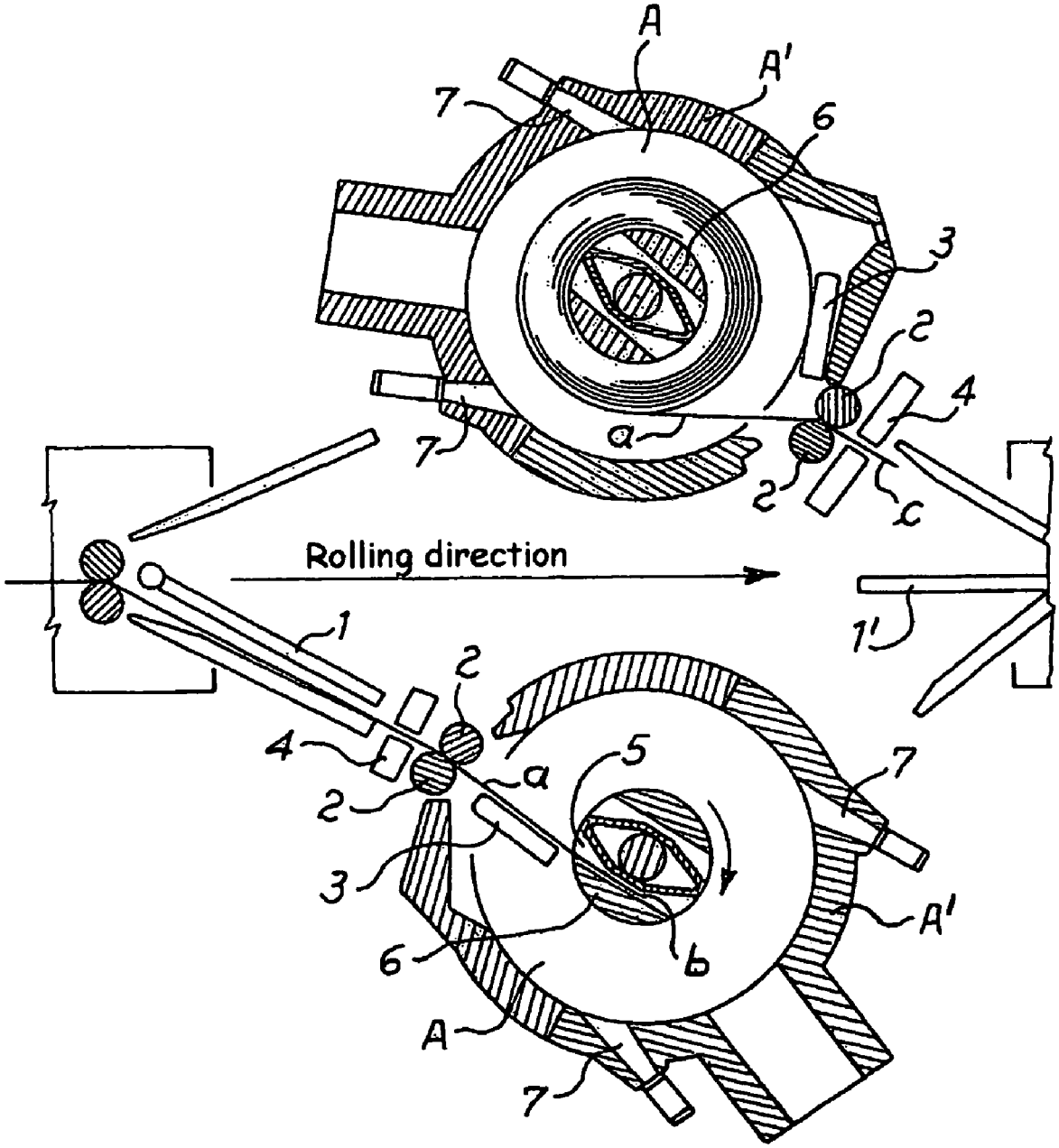
FIG. 1 shows a sectional view of said embodiment in which the two devices forming the inventive system are superimposed to each other.

Referring now to FIG. 1, there is shown the configuration according to the invention in which both superimposed coiling/uncoiling devices A of pre-strip a are allowed to alternately rotate about their own horizontal axis in clockwise and counter-clockwise direction at an angle comprised between 40 and 120°, in order to ensure continuity between the in-line casting and hot rolling step and the final rolling. Each one of both devices A is separately heated by suitable burners 4 of natural gas and is independently operated by means of a special software able to control both the coiling/uncoiling speed and the heating temperature. Furthermore, in order to ensure a quick insertion to the descaling systems and subsequently to the finishing rolling mill placed downstream, the tail c of the pre-strip is intentionally let come out from the protecting envelope by a length comprised between 0 and 800 mm and, prior to the final rolling, it is heated by said burners 4 (blown out during the coiling step) required to ensure the thermal uniformity with the remaining pre-strip a being coiled and heated within device A.

It is to be noted that the coiling/uncoiling device A can preferably include subsidiary equipments to aid the input or output of the pre-strip at the openings of the outer envelope.

To this end, as a preferred but non-limiting solution, there could be adopted the one of the prior art disclosed in patent IT 1245612, in which the strips are directed inwardly and outwardly by a couple of rolls 2 placed at the inlet of devices A and supported during the coiling step by a plate 3 that is located within the protecting shell to aid the insertion thereof in a coiling chuck 6.

To this end, as preferred solution, each coiling device A comprises within an insulated envelope A' a fixed, not expandable chuck 6, in whose structure a slot 5 for the insertion of head b of the pre-strip is present as well as second burners 7 to equalize the temperature of strip a both during the coiling and uncoiling step. The combustion of burners 7 is controlled by a specific software according to an algorithm which controls the relevant stoichiometric ratio intentionally unbalanced with an excess of gas (reducing combustion) in order to aid the formation of an oxide easily removable by the descaling devices placed downstream before the final rolling. The control software of burners 7 is also provided with an algorithm able to increase or decrease the flow rate of the burners to obtain a steady temperature between the leading end and trailing end of the strip both during the coiling and uncoiling step, or as a function of the kind of steel of pre-strip a and the properties the finished product must have.

The envelope A' has an opening defined by the couple of rollers 2 that in the coiling step is oriented upstream with respect to the rolling direction for receiving the pre-strip a to be coiled (FIG. 1—lower device), while in the uncoiling step is oriented downstream when the pre-strip uncoils for being directed to the final rolling (FIG. 1—upper device). This operation is made possible because the whole device A can rotate on itself by an angle comprised between 40 and 120° about its own axis, so as to allow the correct alignment of the opening defined by rollers 2 with the upstream and downstream portions, respectively for the lower and upper device, of the line in which it is inserted.

Suitable control means cause the rotation of a deflecting element or pass-line 1 till it is oriented towards the opening of rollers 2, so as to guide pre-strip a towards device A (the lower one in FIG. 1), and once fed forward by rollers 2, to enter and mesh in slot 5 of chuck 6, that by rotating clockwise as shown by the arrow, causes coiling thereof about itself.

At the opening between rollers 2, in uncoiling condition (upper device), after the burners 4 have heated the tail end c of the strip, the deflecting element is oriented upwards to support said tail and aid the fitting thereof into the downstream devices, and thus towards the final rolling. Obviously the deflecting or coiling-helping element 1 as well as the uncoiling-helping element 1' of the pre-strip could be made in any other equivalent and aim-suited way.

With a view to avoid undesired difficulties between the coiling and uncoiling steps in the upper and lower devices, a special algorithm of the controlling software of devices A speeds up the coiling step of pre-strip a when this is cut by shears (not shown) placed at the end of the in-line casting and hot rolling system (cast-rolling), so as to create the required room for ensuring the right positioning of helping element 1.

The controlling software comprises also an algorithm which allows to slow down the coiling step when this is going to end and the distance from the following strip is enough to ensure the coiling thereof, thus enhancing the heating of tail c that will remain out of device A and rollers 2.

Figure 2:
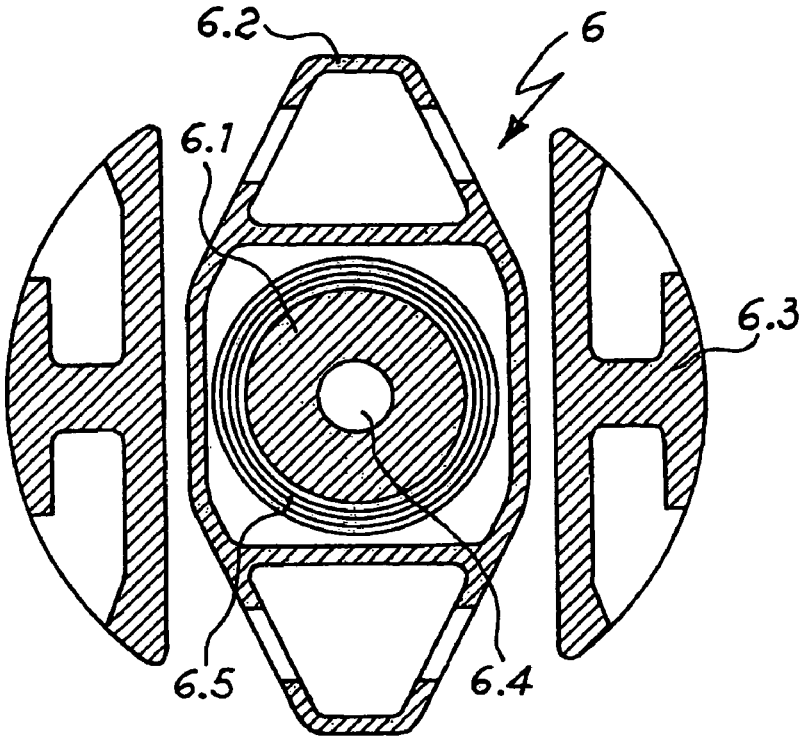
FIG. 2 shows a cross-sectional schematic view of the central chuck of each single coiling/uncoiling device of the system.
Figure 3:
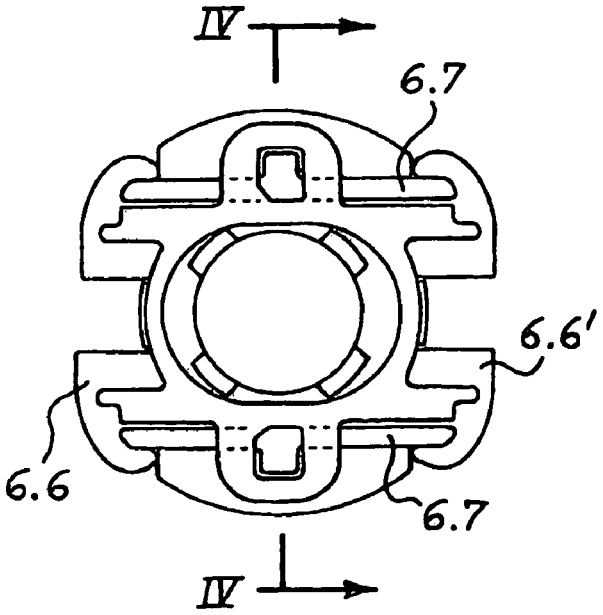
FIGS. 3 and 4 respectively show a frontal view and a sectional view along line IV-IV thereof of a preferred embodiment for joining by fitting the chuck central body to the lateral segments.
Figure 4:
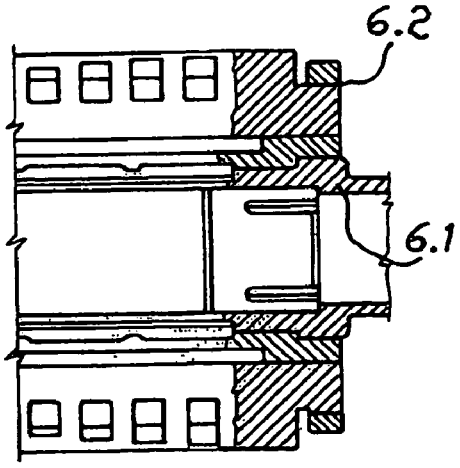

A preferred embodiment of chuck 6 to be used for the device A is shown in greater detail in FIGS. 2-4. With reference to FIG. 2, there is seen the hollow central shaft 6.1 of the chuck within a central body 6.2; at the sides thereof two steel segments 6.3 are provided, appropriately lightened as the same central body 6.2. The shaft 6.1 is cooled with water flowing in the axial hole 6.4 and has outside an insulating layer 6.5, which by limiting the passage of heat between the shaft and central body 6.2 minimizes the cooling of the first length b of the coiling strip which corresponds to the uncoiling tail for the subsequent rolling, as well as of the inner part of device A.

Such a preferred embodiment provides that the central body 6.2 is fixedly joined to lateral segments 6.3 by means of shaped claws 6.6, 6.6' which engage with spacers 6.7 inserted for allowing the assembly without the aid of tie rods as required in conventional embodiments. These latter were particularly unreliable owing to the unavoidable failures occurring as a consequence of stresses at the high working temperatures, and the replacement thereof involved each time a stopping period of two or more days.

The particular embodiment shown in FIGS. 3 and 4 has not only the purpose of increasing the reliability of the chuck and its easy feasibleness, but also of being able to hold up the counterpull between said device and the downstream devices, namely between the descaler and finishing rolling mill.

The invention claimed is:

1. A thermo-electromechanical system comprising two mutually superimposed devices (A) in respective fireproof shells (A') with inner burners (7) of natural gas, able to coil, on a relevant central chuck (6) by means of couples of input and output rolls (2), a pre-strip (*a*) with a thickness comprised between 30 and 8 mm from a roughing mill directly connected to a casting line for thin slabs, and subsequently to rotate on themselves and uncoil said pre-strip for allowing the inlet to the following descaler and finishing rolling mill, characterized in that said devices (A) are also provided with outer (4) burners;

said inner burners (7) are able to optimise the temperature of the pre-strip (*a*) to be entered into the finishing roller mill, by means of a suitable control software also provided with an algorithm able to change the flow rate of burners to achieve automatically a steady temperature between the leading and trailing ends of the strip both when coiled and uncoiled or as a function of the kind of steel of pre-strip (*a*) and the properties to be obtained on the finished product;

said outer burners (4) are able to homogenize through a special control software the temperature of pre-strip (*a*) on the whole length thereof from the coiled core to a terminal tail portion (*c*), which remains outside, whereby the complete uniformity of the mechanical and geometric characteristics of the final product, responsive to temperature changes, is ensured;

actuating means are provided for the rotation of chucks (6) of upper and lower devices (A) both when coiled and uncoiled under control of special algorithms of the controlling software to speed up or slow down the coiling of pre-strip (*a*);

control means are provided for the speed of said pre-strip (*a*) both when being coiled and uncoiled, consisting of a special process software in order to avoid stretches or compressions of pre-strip, such as to jeopardize the geometric quality of the final product; and means are provided for operating the stop of the chuck (6) by leaving said tail end (*c*) of pre-strip upon coiling at the outside of said devices (A) and said couples of rolls (2) for a length comprised between 0 and 800 mm, thus making easier, in the subsequent uncoiling, its entering to the following descaling and final rolling up to the finishing roll train.

2. A system according to claim 1, characterized in that, downstream of the in-line casting and hot rolling step, a shear cuts the pre-strip, and a first one of said controlling software algorithms of devices (A) speeds up the coiling thereof so as to create the required room to ensure the correct positioning of a helping device (1) to receive on the coiling device (A) the following strip.

3. A system according to claim 1, characterized by comprising a second algorithm of the control software suitable to allow the slowing down of the coiling step, immediately before its completion, when the distance from the following strip is sufficient to ensure its coiling, thus assisting the heating of the terminal portion (*c*) left outside the device (A) and rolls (2).

4. A system according to claim 1, characterized in that said chuck (6) on which the pre-strip (*a*) is wound comprises a drum formed of a central body (6.2) with central shaft (6.1) and side segments (6.3) held together by mutually fitted parts (6.6, 6.7, 6.6', 6.7') without the aid of bolts.

5. A system according to claim 4, characterized in that said chuck (6) is thermally insulated from the central shaft (6.1) on which it is mounted, the latter being hollow with an axial hole (6.4) for the cooling water, thus avoiding that the head and outgoing tail of the entering pre-strip (*b*) undergo such cooling as to jeopardize its capability to be rolled.

6. A process for the thermo-mechanical treatment of a pre-strip (*a*) with a thickness comprised between 30 and 8 mm from a roughing mill directly connected to a casting line for thin slabs, comprising:

the coiling and subsequent uncoiling of the pre-strip (*a*) to allow its forwarding to a finishing rolling;

heating (7) the pre-strip (*a*) by burning natural gas during the coiling and uncoiling steps inside coiling devices (A), heating (4) the pre-strip(*a*) outside said coiling devices (A), with said inside heating (7) being controlled by a special software of the pre-strip (*a*);

controlling, through special algorithms of the process software, the coiling step for its respective speeding up or slowing down; and controlling, through a special process software, the speed of the pre-strip (*a*) during the coiling and uncoiling steps, wherein the combustion for heating the pre-strip (*a*) within the coiling devices (A) occurs with an excess of gas with respect to the stoichiometric ratio in order to assist in a reducing environment the formation of a surface oxide easily removable as a scale in a subsequent descaling step.

7. A process for the thermo-mechanical treatment of a pre-strip (*a*) with a thickness comprised between 30 and 8 mm from a roughing mill directly connected to a casting line for thin slabs, comprising:

coiling and subsequent uncoiling of the pre-strip (*a*) to allow its forwarding to a finishing rolling;

heating (7) the pre-strip (*a*) by burning natural gas during the coiling and uncoiling steps inside coiling devices (A), with said inside heating (7) being controlled by a special software of the pre-strip (*a*);

heating (4) the pre-strip (*a*) outside said coiling devices (A);

controlling, through special algorithms of the process software, the coiling step for its respective speeding up or slowing down; and controlling, through a special process software, the speed of the pre-strip (*a*) during the coiling and uncoiling steps, wherein the combustion for heating the pre-strip (*a*) within the coiling devices (A) occurs with an excess of gas with respect to the stoichiometric ratio in order to assist in a reducing environment the formation of a surface oxide easily removable as a scale in a subsequent desealing step.

* * * * *